US009325087B2

(12) United States Patent
Chawla et al.

(10) Patent No.: US 9,325,087 B2
(45) Date of Patent: Apr. 26, 2016

(54) ELECTRONIC ASSEMBLIES WITH SCALABLE CLIP-TYPE CONNECTORS

(71) Applicants: Gaurav Chawla, Tempe, AZ (US); Joshua D. Heppner, Chandler, AZ (US); Jeffory L Smalley, East Olympia, WA (US); Vijaykumar Krithivasan, Chandler, AZ (US)

(72) Inventors: Gaurav Chawla, Tempe, AZ (US); Joshua D. Heppner, Chandler, AZ (US); Jeffory L Smalley, East Olympia, WA (US); Vijaykumar Krithivasan, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 62 days.

(21) Appl. No.: 14/229,157

(22) Filed: Mar. 28, 2014

(65) Prior Publication Data

US 2015/0280337 A1 Oct. 1, 2015

(51) Int. Cl.

| | |
|---|---|
| ***H01R 4/48*** | (2006.01) |
| ***H01R 11/24*** | (2006.01) |
| ***H01R 12/72*** | (2011.01) |
| ***H01R 12/88*** | (2011.01) |

(52) U.S. Cl.
CPC ..... *H01R 11/24* (2013.01); *H01R 12/721* (2013.01); *H01R 12/88* (2013.01); *Y10T 29/4913* (2015.01)

(58) Field of Classification Search
CPC ..... H01R 11/24; H01R 13/15; H01R 11/282; H01R 2201/12
USPC ..... 439/822, 912
See application file for complete search history.

(56) References Cited

U.S. PATENT DOCUMENTS

| | | | | |
|---|---|---|---|---|
| RE28,064 | E * | 7/1974 | Venalleck | 439/269.1 |
| 4,640,563 | A * | 2/1987 | LeBlanc | 439/217 |
| 4,749,362 | A * | 6/1988 | Hoffman et al. | 439/269.1 |
| 4,981,441 | A * | 1/1991 | Ignasiak | 439/269.1 |

* cited by examiner

*Primary Examiner* — Phuong Dinh
(74) *Attorney, Agent, or Firm* — Blakely, Sokoloff, Taylor & Zafman LLP

(57) ABSTRACT

A clip-type connector for electrically coupling a substrate with a device or another substrate is disclosed. An electrical connector comprises a top plate and a bottom plate. An array of contacts are on at least one of the top plate and bottom plate. A hinge is located between the top plate and the bottom plate such that the hinge mechanically connects the top plate to the bottom plate. A spring applying a force against the top and bottom plates.

25 Claims, 12 Drawing Sheets

ELECTRONIC ASSEMBLIES WITH SCALABLE CLIP-TYPE CONNECTORS

TECHNICAL FIELD

Embodiments of the present invention relate generally to edge connectors. More particularly, embodiments of the present invention relate to electronic assemblies with scalable clip-type connectors and connection protrusions.

BACKGROUND

An increasing demand for faster modern computer devices such as mainframe computers, dedicated servers, and desktop computers has reciprocated an increase in demand for faster signal channeling speeds from critical components such as processors, graphics devices, and memory devices. Currently, edge connectors remain the simplest design option of the various connector designs for channeling high-speed signals from computer packages.

As illustrated in FIG. 10, a conventional edge connector 1000 is formed of a rectangular plastic piece 1001 with an opening 1002 on one side, with contacts 1003 on one or both sides of the opening 1002, sprung to push into the middle of the opening 1002. A connection protrusion 1005 is keyed to fit in the opening 1002 of the conventional edge connector 1000. The connection protrusion 1005 may be part of a printed circuit board (PCB) that protrudes from a side of the PCB and makes connection with the conventional edge connector 1000. The conventional edge connector 1000 risks contact plating damage when mating with the connection protrusion 1005. The conventional edge connector's contacts 1003 travel on the connection protrusion's substrate 1009 before reaching the connection protrusion's pads 1011, thereby leading to possible deterioration of the pads 1011 and contacts 1003 and of any electrical connection between them. As such, connection protrusions 1005 have elongated pads 1011 that extend to the edge of the connection protrusion 1005 upon which the contacts 1003 slide.

DETAILED DESCRIPTION

Electronic assemblies with scalable clip-type connectors and connection protrusions are disclosed. Embodiments of the present invention are described with respect to specific details in order to provide a thorough understanding of the invention. One of ordinary skill in the art will appreciate that embodiments of the invention can be practiced without these specific details. Additionally, the various embodiments shown in the figures are illustrative representations and are not necessarily drawn to scale.

Embodiments of the invention are directed to clip-type connectors. In one embodiment of the invention, a clip-type connector includes a top plate and a bottom plate that are connected together by a hinge. An array of contacts is on at least one of the top and bottom plates. A spring applies force against the top and bottom plates to draw a portion of the top and bottom plates toward one another.

To make electrical connection between the array of contacts and a substrate, the clip-type connector is opened at one end by an applied force. The clip-type connector is then aligned to the substrate to position the substrate in the opened end between the top and bottom plates of the clip-type connector. The force is then removed to close the array of contacts onto the substrate, thus forming an electrical connection. The array of contacts does not travel on the substrate before making contact with the pads.

In an embodiment, the clip-type connector includes locking features that prevent the clip-type connector from inadvertently separating from the substrate after electrical connection has been made. Additionally, in an embodiment, the clip-type connector includes stopping features that prevent the substrate from entering too far into the clip-type connector. Furthermore, flex cables may electrically couple to the clip-type connector, which may then be electrically coupled to the substrate. The clip-type connector enables electrical coupling to a substrate without causing the array of contacts to travel on the substrate. Additionally, the clip-type connector can be scaled according to design requirements.

Figure 1A:
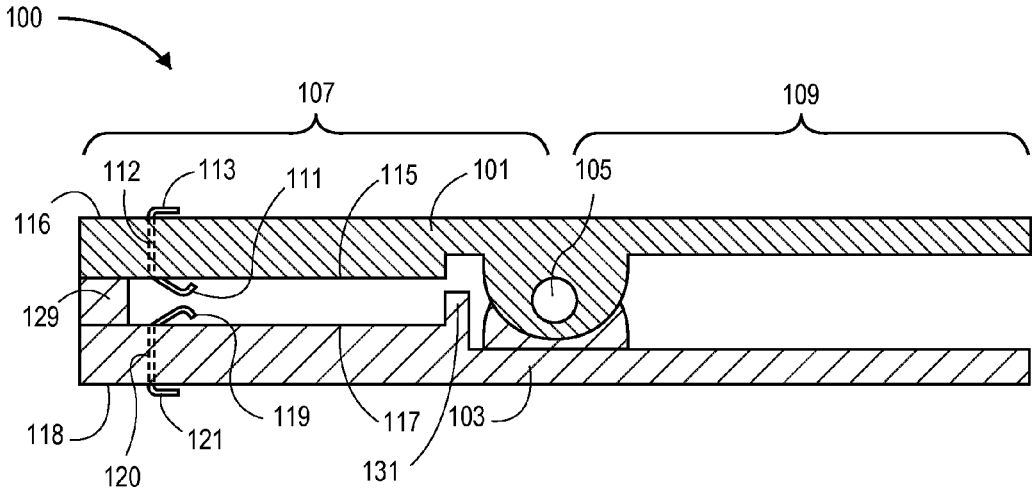
FIGS. 1A-1B illustrate a side view and an isometric view of a clip-type connector, in accordance with an embodiment of the invention.
Figure 1B:
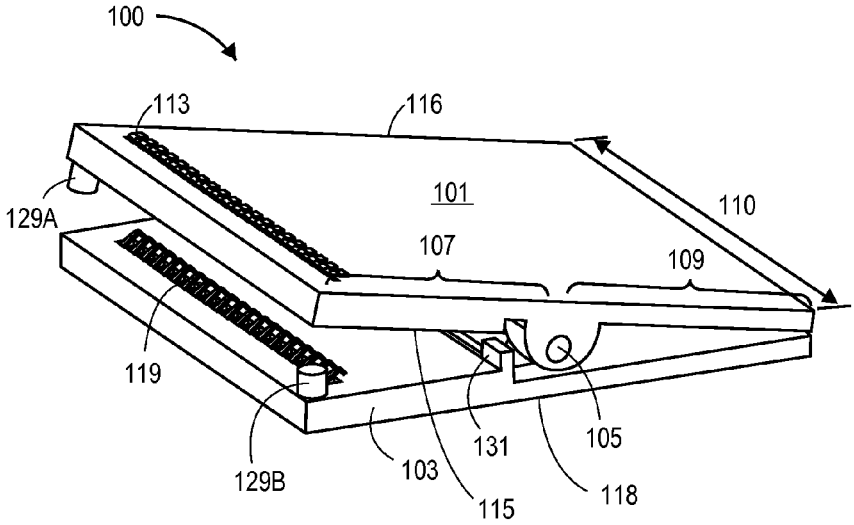

FIGS. 1A-1B illustrate a clip-type connector in accordance with an embodiment of the invention. A side view of a clip-type connector 100 in accordance with an embodiment of the invention is illustrated in FIG. 1A. The clip-type connector 100 includes a top plate 101 and a bottom plate 103 that are mechanically coupled to one another by a hinge 105. The hinge 105 is located between the top and bottom plates 101 and 103. The top plate 101 and bottom plate 103 each have an engaging region 107 and a non-engaging region 109 that are separated by the location of the hinge 105. In an embodiment, the hinge 105 is a spring-loaded hinge that draws the engaging regions 107 of the top and bottom plates 101 and 103, respectively, toward one another. The engaging region 107 of the top plate 101 includes an array of top contacts 111 on an inner side 115 of the top plate 101, and an array of top couplers 113 on an outer side 116 of the top plate 101. Similarly, in an embodiment, the engaging region 107 of the bottom plate 103 includes an array of bottom contacts 119 on an inner side 117 of the bottom plate 103, and an array of bottom couplers 121 on an outer side 118 of the bottom plate 103. The couplers 113 and 121 are electrically coupled to the contacts 111 and 119, respectively. In an embodiment, the each contact 111 and each top coupler 113 are formed from one integrated structure that extends through the top plate 101, as indicated by the dotted structure 112. Additionally, in an embodiment, each bottom contact 119 and each bottom coupler 121 are formed from one integrated structure that extends through the bottom plate 103, as indicated by the dotted structure 120. In an embodiment, the clip-type connector 100 includes a locking feature 129 that prevents the clip-type connector 100 from inadvertently disengaging from a substrate when engaged. Additionally, in an embodiment, the clip-type connector 100 includes a stopping feature 131 that prevents the substrate from inserting too far into the clip-type connector 100.

FIG. 1B illustrates an isometric view of an opened clip-type connector 100 in accordance with an embodiment of the invention. In an embodiment, the arrays of contacts 111 and 119 extend across a portion of a width 110 of the top and bottom plates 101 and 103, respectively. In an embodiment, the width 110 is the distance that runs along the length of the hinge 105. As shown in FIG. 1B, the top and bottom arrays of contacts 111 and 119 extend more than half a distance of the width 110 of the top and bottom plates 101 and 103, respectively. In an embodiment, a pair of locking features 129 protrudes from the inner sides 115 and 117 of the top and bottom plates 101 and 103, respectively. In a particular embodiment, a top locking feature 129A protrudes from the top plate 101 and a bottom locking feature 129B protrudes from the bottom plate 103.

Figure 2A:
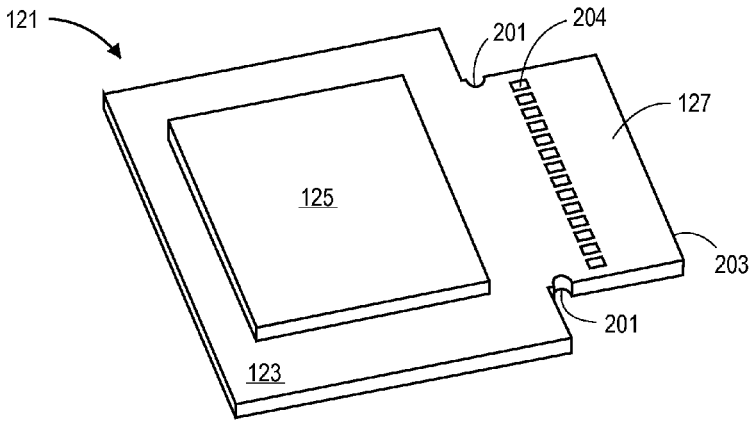
FIG. 2A illustrates an isometric view of a package with features for mating with a clip-type connector, in accordance with an embodiment of the invention.

FIG. 2A illustrates an isometric view of a package 121 with features for mating with a clip-type connector in accordance with an embodiment of the invention. In an embodiment, the package 121 includes a package substrate 123 and a die 125. The die 125 may be a microelectronic device that is constructed from a bulk monocrystalline semiconductor substrate, on top of which are semiconductor devices, metal interconnect layers electrically coupled to the semiconductor devices, a passivation layer disposed over the metal interconnect layers, and finally, contacts exposed in openings in the passivation layer and electrically coupled to the metal interconnect layers. The die 125 may be any device such as, but not limited to, a processor, a graphics device, and a memory device. In an embodiment, the die 125 is flip-chip bonded to the substrate 123 such that the die 125 is electrically coupled with the substrate 123.

As further depicted in FIG. 2A, the diving board 127 protrudes from a side of the substrate 123. In embodiments, the diving board 127 is an extension of the substrate 123 such that the diving board 127 and the substrate 123 form one monolithic substrate. The diving board 127 has an edge 203 that may make contact with the stopping feature 131 of the clip-type connector 100 for alignment and tactile feedback purposes, as will be discussed further below. In an embodiment, the diving board 127 is a connection protrusion. The diving board 127 includes an array of pads 204 that are electrically coupled to the die 125 through redistribution lines (not shown) within, on top, or on bottom of the substrate 123. In an embodiment, two arrays of pads 204 are located on the diving board 127, one on the top and one on the bottom, for the top and bottom contacts 111 and 119, respectively. The array of pads 204 may correspond to the arrays of contacts 111 and 119 on the clip-type connector 100. In an embodiment, each pad in the array of pads 204 corresponds to a specific contact in one clip-type connector 100. Alternatively, in an embodiment, a portion of the array of pads 204 correspond to an array of contacts on a first clip-type connector and another portion of the array of pads 204 corresponds to an array of contacts on a second clip-type connector. The array of pads 204 may not extend to the edge 203 of the diving board 127. In an embodiment, each pad in the array of pads 204 does not extend to the edge 203 of the diving board 127. As such, the diving board 127, such as a connection protrusion, may be scaled according to design requirements. Alternatively, in an embodiment, at least one pad extends partially or all the way to the edge 203 of the diving board 127. In an embodiment, the diving board 127 is scaled such that more than one array of pads 204 are located on one side of the diving board 127. The diving board 127 may also include locking keys 201. In an embodiment, the locking keys 201 are notches formed on edges of the diving board 127 into which locking features 129 of the clip-type connector 100 insert.

Figure 2B:
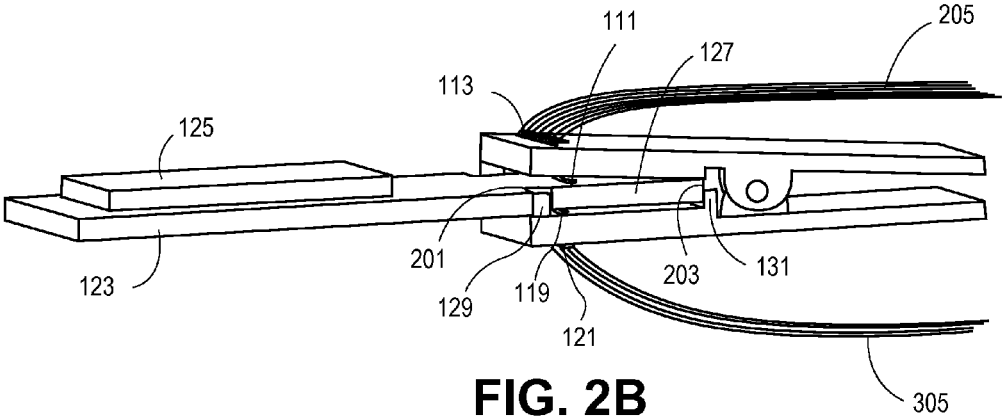
FIG. 2B illustrates an isometric view of an electronic assembly with a clip-type connector, in accordance with an embodiment of the invention.

FIG. 2B illustrates an isometric view of an electronic assembly with a clip-type connector, in accordance with an embodiment of the invention. In an embodiment, the electronic assembly includes a package electrically connected to an array of cables 205 with a clip-type connector. The package may include a die 125 electrically coupled to a package substrate 123, and a diving board 127 with pads 204 (as shown in FIG. 2A). In an embodiment, the array of cables 205 are attached to the top and bottom arrays of couplers 113 and 121, which electrically couple the array of cables 205 to the top and bottom arrays of contacts 111 and 119. The array of cables 205 may be any suitable high density electrical transmission line such as, but not limited to, a flex cable, an array of micro coaxial cables, interposer attachments, optical cables, or a substrate material layer embedded with patterned conductive lines. The array of cables 205 may electrically couple the package substrate 123 to a separate device or substrate, such as a printed circuit board (PCB).

When the clip-type connector is engaged in electrical connection with the package substrate 123, the top and bottom arrays of contacts 111 and 119 are pressed upon their respective arrays of pads 204 on the diving board 127. In an embodiment, each contact in the top and bottom arrays of contacts 111 and 119 are spring-type contacts, such as but not limited to cantilever contacts and land grid array (LGA)-type contacts. The spring-type contacts substantially minimize relative motion between the arrays of contacts 111 and 119 and the pads 204 on the diving board 127. As such, physical degradation of the arrays of contacts 111 and 119 as well as degradation of the electrical connection between the arrays of contacts 111 and 119 and the pads 204 are significantly minimized. In an embodiment, the edge 203 of the diving board 127 makes contact with the stopping feature 131. In an embodiment, the stopping feature 131 has a height that is at least half of a distance between the top and bottom plates 101 and 103. The stopping feature 131 prevents the diving board 127 from inserting too far into the clip-type connector 100. Furthermore, in an embodiment, the stopping feature 131 is an alignment structure designed to stop the diving board 127 when the pads 204 are horizontally aligned with the contacts 111 and 119. The stopping feature 131 may also provide tactile feedback to the user when the diving board 127 bumps into the stopping feature 131. The tactile feedback may indicate to the user that the clip-type connector 100 is now positioned to allow the arrays of contacts 111 and 119 to contact the pads 204.

As further illustrated in FIG. 2B, the locking features 129 of the clip-type connector insert into the locking keys 201 of the diving board 127. In an embodiment, the locking features 129 prevent the clip-type connector from inadvertently separating from the diving board 127 when the clip-type connector is engaged in electrical connection with the diving board 127. Additionally, in an embodiment, the locking features 129 help align the clip-type connector to the diving board 127 by fitting into the locking keys 201 when the clip-type connector is aligned with the diving board 127. In an embodiment, the locking features 129 are taller than the combined height of the tallest contact in each of the arrays of contacts 111 and 119. As such, the top array of contacts 111 are protected from being damaged by the bottom array of contacts 119, and vice versa, when the clip-type connector 100 is not connected to the diving board 127 and in a closed position, as shown in FIG. 1A. In embodiments, the amount of pressure required to be exerted onto the pads 204 by the contacts 111 and 119 may determine the dimensions of the clip-type connector 100, as discussed in more detail in FIG. 3 below.

Figure 3A:
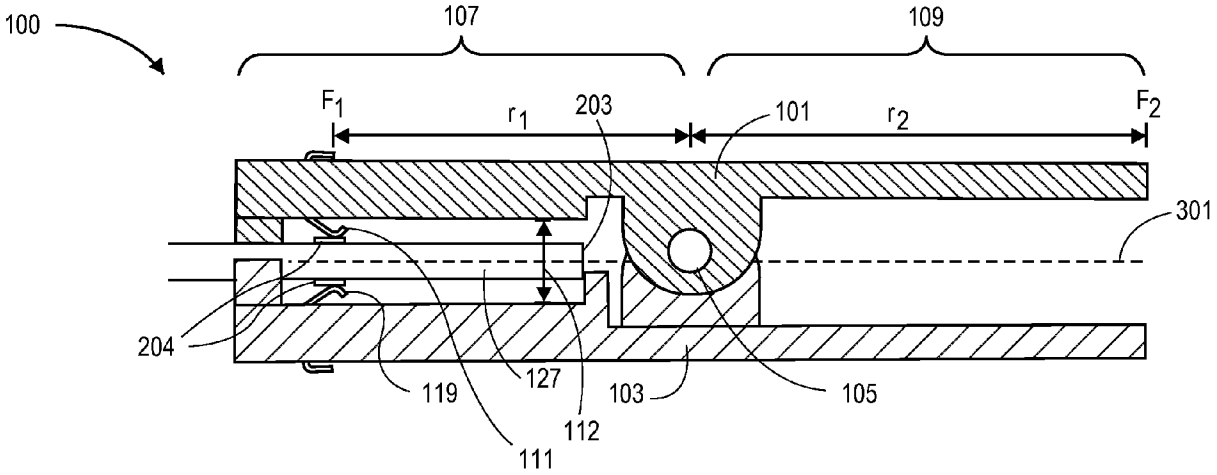
FIG. 3A illustrates a side view perspective of a clip-type connector and the specific dimensions that affect its operation, in accordance with an embodiment of the invention.

FIG. 3A illustrates a side view perspective of a clip-type connector 100 and the specific dimensions that affect its operation, in accordance with an embodiment of the invention. The clip-type connector 100 includes a spring-loaded hinge 105 in between a top plate 101 and a bottom plate 103. In an embodiment, the top and bottom plates 101 and 103 are separated by a separation height 112. The separation height 112 may be adjusted according to the thickness of the diving board 127 so that the contacts 111 and 119 are not overly strained. For example, the separation height 112 may increase when the thickness of the diving board 127 increases. Additionally, the separation height 112 may decrease when the thickness of the diving board 127 decreases. As such, the separation height 112 may allow the contacts 111 and 119 to operate at an ample contact height.

In embodiments, the force $F_1$ is a spring-generated downward force in an engaging region 107 created by the spring-loaded hinge 105. The force $F_1$ is applied at a distance $r_1$ away from the hinge 105. The force $F_1$ presses an array of contacts 111 onto pads 204 on a diving board 127, causing the contacts 111 to make sufficient electrical connection with the pads 204 on the diving board 127. The force $F_2$ is a user-generated downward force in a non-engaging region 109 that creates an opposing upward force in the engaging region 107 against $F_1$. The force $F_2$ is applied at a distance $r_2$ away from the hinge 105. In embodiments, the clip-type connector 100 is opened by applying a force $F_2$ to create an opposing upward force in the engaging region 107 that is larger in magnitude than that of force $F_1$. The forces $F_1$ and $F_2$ applied to the top plate 101 may be equal in magnitude, but inverted in direction, to forces applied to the bottom plate 103 due to a substantial symmetry of the clip-type connector 100 across a central horizontal plane 301. As such, for purposes of simplicity, discussions for FIG. 3 herein relate solely to the dimensions of the top plate 101, but are understood to be equally applicable to the bottom plate 103.

The dimensions of the clip-type connector, such as $r_1$, $r_2$, and the hinge 105, can be designed using the magnitude of the forces $F_1$ and $F_2$. In embodiments, the magnitude of the force $F_1$ largely depends on the force requirement of the array of contacts 111. In one embodiment, each contact in the array of contacts 111 requires an enabling force in the rage of 10-20 grams-force (gf). Accordingly, in an embodiment, the force $F_1$ is equal to or greater than the cumulative enabling force required by the array of contacts 111. For example, in an embodiment, for a clip-type connector 100 having an array of 200 contacts where each contact has a 15 gf contact force requirement, the total average force required for $F_1$ is 6.6 pounds-force (lbf).

Subsequently, the hinge 105 can be designed using the calculated force $F_1$ and the distance $r_1$. In embodiments, the moment requirement at the hinge 105 can be calculated by the equation:

$$M_{hinge}=F_1\times r_1$$

where $F_1$ is the force requirement and $r_1$ is the distance of $F_1$ from the hinge 105. The moment requirement at the hinge 105 may be not too strong to cause the contacts 111 and 119 to collapse from excessive force and not too weak to allow the clip-type connector to inadvertently open. In one particular embodiment, the moment requirement at the hinge is in the range of 20 to 40 lbf·mm. In an embodiment, $r_1$ is determined based upon the designed location of the pads 204 on the diving board 127. For example, $r_1$ can be the distance between the pads 204 and the edge 203 of the diving board 127. In an embodiment, $r_1$ is a distance in the range of 3 to 7 mm. Continuing with the example above, if $F_1$ is 6.6 lbf and $r_1$ is 5 mm, the moment required ($M_{hinge}$) is 33 lbf·mm.

Thereafter, $M_{hinge}$ may be used to design the hinge spring according to techniques well known in the art. The hinge spring may be any suitable type of spring, such as but not limited to, torsion springs and sheet metal springs. In the embodiment depicted in FIG. 3A, the spring-loaded hinge 105 includes a torsion spring that coils around the hinge 105 and is thus not shown. Alternatively, in an embodiment, tension coil springs and compression coil springs are used to operate the clip-type connector 100. A clip-type connector 100 utilizing tension and compression coil springs is illustrated in FIG. 3B.

Figure 3B:
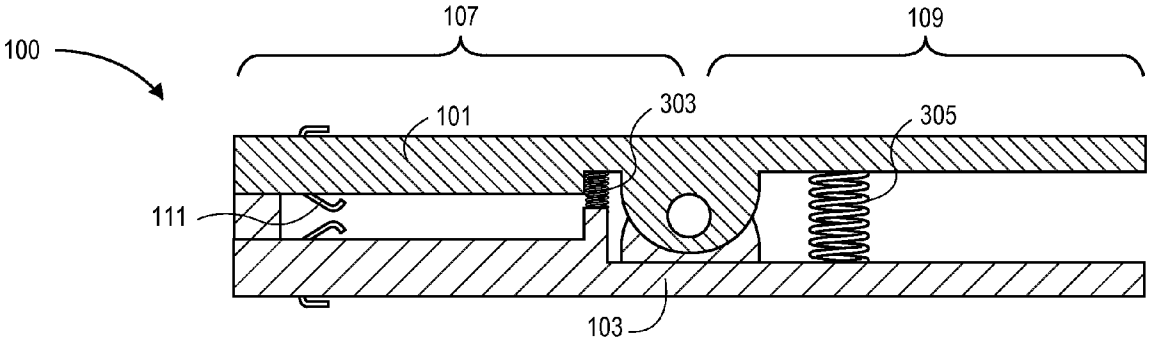
FIG. 3B illustrates a clip-type connector with coil springs, in accordance with an embodiment of the invention.

With brief reference to FIG. 3B, two coil springs are used in lieu of the torsion spring in the spring-loaded hinge 105 from FIG. 3A to operate the clip-type connector 100 as illustrated. An engaging coil spring 303 is placed between the top and bottom plates 101 and 103 in the engaging region 107 to apply a constant downward force for the contacts 111. Additionally, a non-engaging coil spring 305 is placed between the top and bottom plates 101 and 103 in the non-engaging region 109 to help open the clip-type connector 100 by generating a force that pulls the non-engaging region 109 of the top plate 101 downward. In an embodiment, the engaging and non-engaging coil springs 303 and 305 are perpendicularly attached to the top and bottom plates 101 and 103. It is to be appreciated that any spring or spring design that can apply constant downward force for the array of contacts 111 may be used for the clip-type connector 100.

Referring now back to FIG. 3A, once the spring is designed, the distance $r_2$ may be designed according to the equation:

$$r_2=M_{hinge}/F_2$$

where $M_{hinge}$ is the moment requirement for the spring-loaded hinge 105 and $F_2$ is the downward force applied on the non-engaging region 109 of the top plate 101. In an embodiment, the magnitude of the force $F_2$ is defined by a target value set to enable ergonomic operation of the clip-type connector 100 by hand and/or to prevent user fatigue from repeated use. In an embodiment, the target value for ergonomic operation by hand is in the range of 3 to 5 lbf. Therefore, continuing with the example above once more, if $M_{hinge}$ is 33 lbf·mm and $F_2$ is 4 lbf, then $r_2$ is approximately 8 mm. As a result of the equations above, given $F_1$ and $F_2$, the clip-type connector 100 can be designed with any dimensions and with any spring-loaded hinge.

Figure 4A:
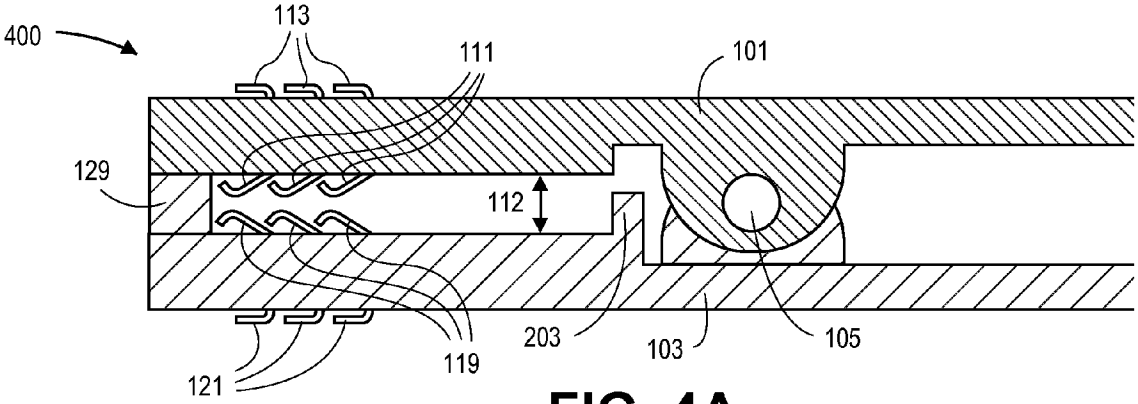
FIGS. 4A-4B illustrate a scaled clip-type connector with top and bottom contacts, in accordance with an embodiment of the invention.
Figure 4B:
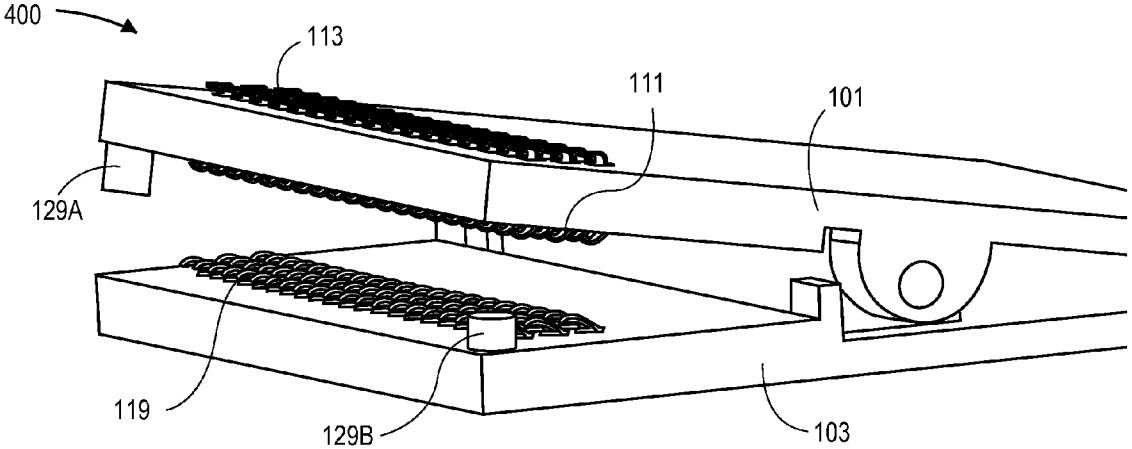
Figure 10:
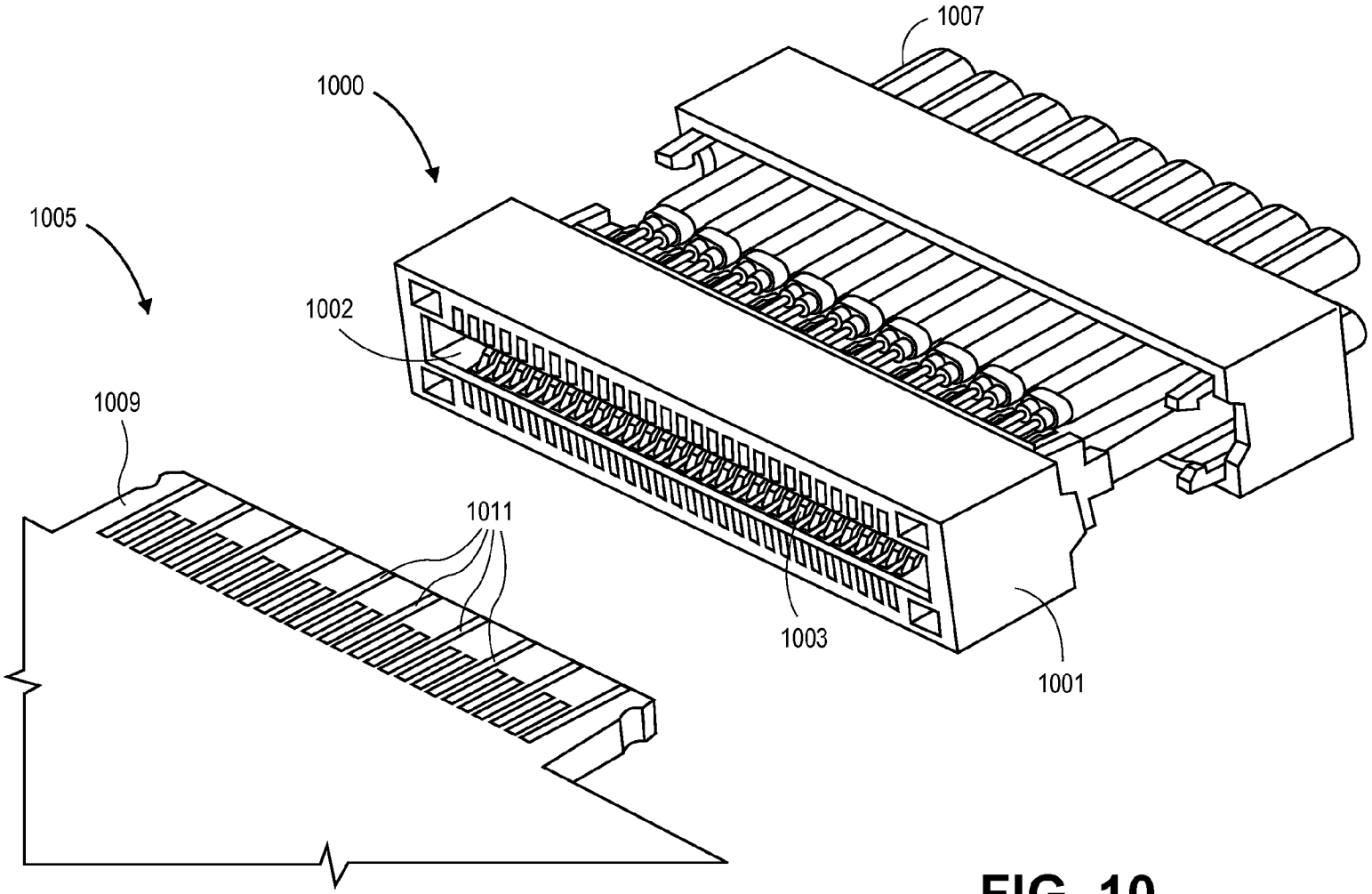
FIG. 10 illustrates an isometric view of a conventional edge connector and a connection protrusion of a printed circuit board.

FIGS. 4A-4B illustrate a scaled clip-type connector with top and bottom contacts, in accordance with an embodiment of the invention. With reference to FIG. 4A, a side view perspective of a scaled clip-type connector 400 with top and bottom contacts according to an embodiment of the invention is illustrated. A scaled clip-type connector may have more than one row of contacts. In the embodiment depicted in FIG. 4A, the scaled clip-type connector 400 has arrays of contacts 111 and 119 that are formed of three rows of contacts. As such, the scaled clip-type connector 400 has 3 times as many rows as a non-scaled clip-type connector, such as a conventional electrical connector 1000 shown in FIG. 10.

Referring now to FIG. 4B, an isometric view of the scaled clip-type connector 400 with top and bottom contacts according to an embodiment of the invention is illustrated. In an embodiment, the scaled clip-type connector 400 may have an m×n array of contacts on at least one of the top or bottom plates 101 or 103, respectively. An m×n array has m number of columns and n number of rows. In the embodiment illustrated in FIG. 4B, the array of contacts 111 and 119 are formed of a 20×3 array of contacts. In an embodiment, the number of contacts in the top array of contacts 111 is equal to the number of contacts in the bottom array of contacts 119. In an embodiment, the arrangement of the top array of contacts 111 is identical to the arrangement of the bottom array of contacts 119. Alternatively, in an embodiment, the number of contacts in the top array of contacts 111 is different than the number of contacts in the bottom array of contacts 119. Furthermore, in an embodiment, the arrangement of the top array of contacts 111 is different than the arrangement of the bottom array of contacts 119. For example, the number of contacts in each row of the top array of contacts 111 may change row by row, whereas the number of contacts in each row of the bottom array of contacts 119 may not change. It is to be appreciated that any combination or arrangement of contacts between and within the top and bottom arrays of contacts 111 and 119 are envisioned in embodiments of the invention.

Figure 4C:
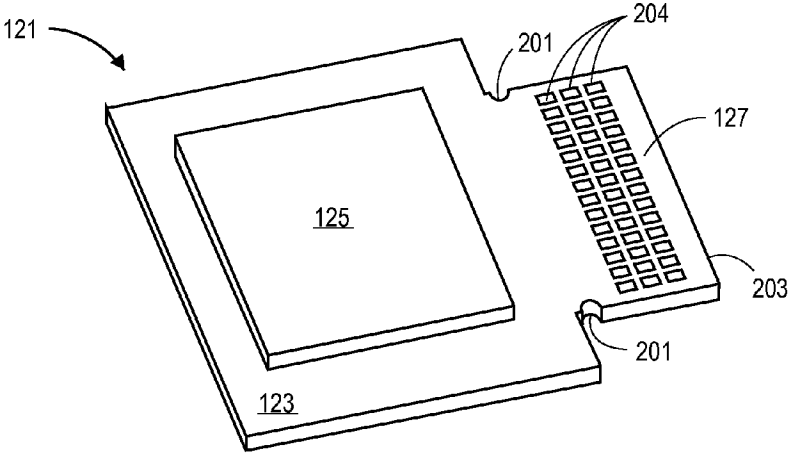
FIG. 4C illustrates a package having a scaled diving board to be mated with a clip-type connector, in accordance with an embodiment of the invention.
Figure 4D:
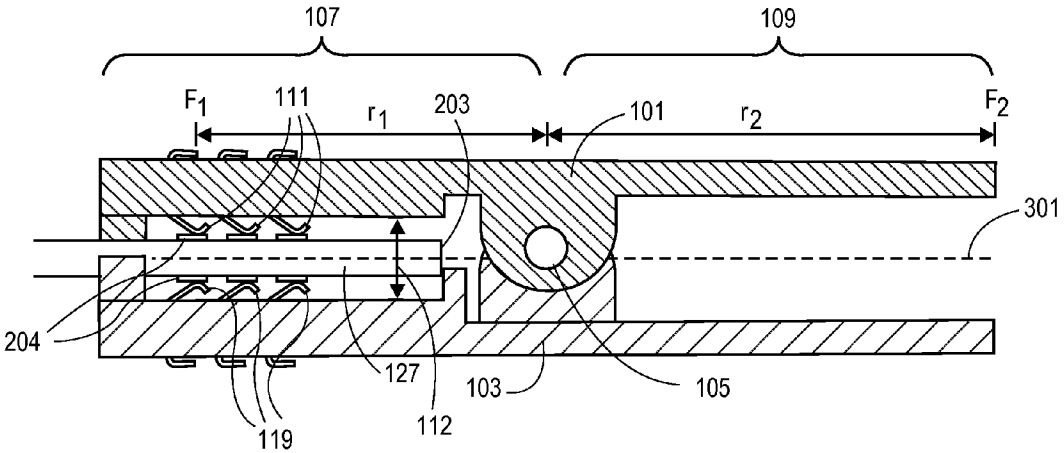
FIG. 4D illustrates a scaled clip-type connector with top and bottom contacts engaged in electrical connection with a package substrate, in accordance with an embodiment of the invention.

FIG. 4C illustrates a package 121 having a scaled diving board 127 to be mated with the clip-type connector illustrated in FIG. 4B. In an embodiment, the scaled diving board 127 is a scaled connection protrusion. The scaled diving board 127 may have an m×n array of pads 204 that matches with the m×n array of contacts 111 and/or 119. As such, in an embodiment, each pad in the array of pads 204 corresponds to a specific contact in the array of contacts 111 and/or 119, as shown in FIG. 4D. In FIG. 4D, the scaled clip-type connector 400 engaged in electrical connection with the package with the scaled diving board 127 is illustrated in accordance with an embodiment of the invention. The contacts 111 and 119 are each in contact with respective pads 204 on the diving board 127. In an embodiment, the separation height 112 is configured to allow even pressure to be applied across the m×n array of contacts 111 and 119 onto the m×n array of pads 204.

Figure 5A:
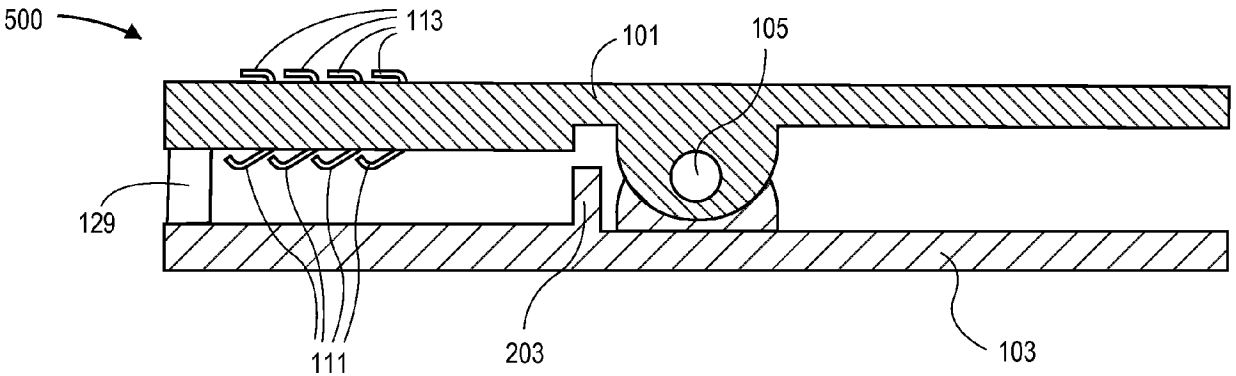
FIGS. 5A-5B illustrate a scaled clip-type connector with top contacts, in accordance with an embodiment of the invention.
Figure 5B:
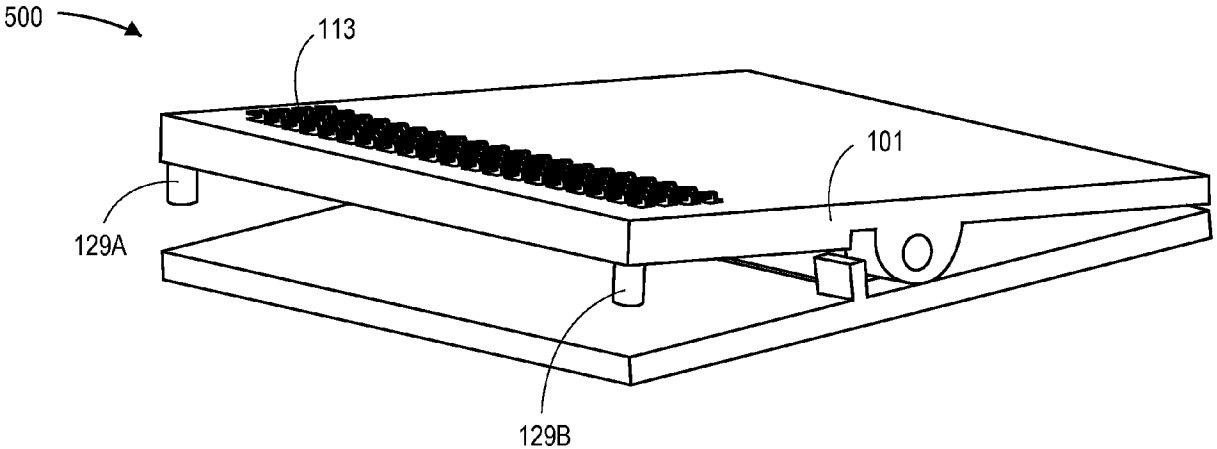

FIGS. 5A-5B illustrate a scaled clip-type connector with top contacts, in accordance with an embodiment of the invention. With reference to FIG. 5A, a side view perspective of a scaled clip-type connector 500 with top contacts according to an embodiment of the invention is illustrated. The top plate 101 includes a scaled array of contacts 111. In an embodiment, as shown in FIG. 5A, the scaled array of contacts 111 is formed of four rows of contacts. As such, the scaled clip-type connector 500 has four times as many rows of contacts as a non-scaled clip-type connector with only one row of contacts, such as the conventional electrical connector 1000 shown in FIG. 10. Although the embodiment in FIG. 5A illustrates a top plate 101 having an array of contacts 119 while the bottom plate 103 does not, in an embodiment, the bottom plate 103 has an array of contacts and the top plate 101 does not. Referring now to FIG. 5B, an isometric view of the scaled clip-type connector with top contacts according to an embodiment of the invention is illustrated. The bottom plate 103 does not have any contacts and may be smooth. The locking features 129A and 129B may both be located on the top plate 101 to protect the top contacts 111, as the bottom plate 103 does not have any contacts that need to be protected. In an embodiment, the locking features 129A and 129B are each taller than the top contacts 111 to protect the top contacts from damage caused by unintentional contact with a substrate.

Figure 6A:
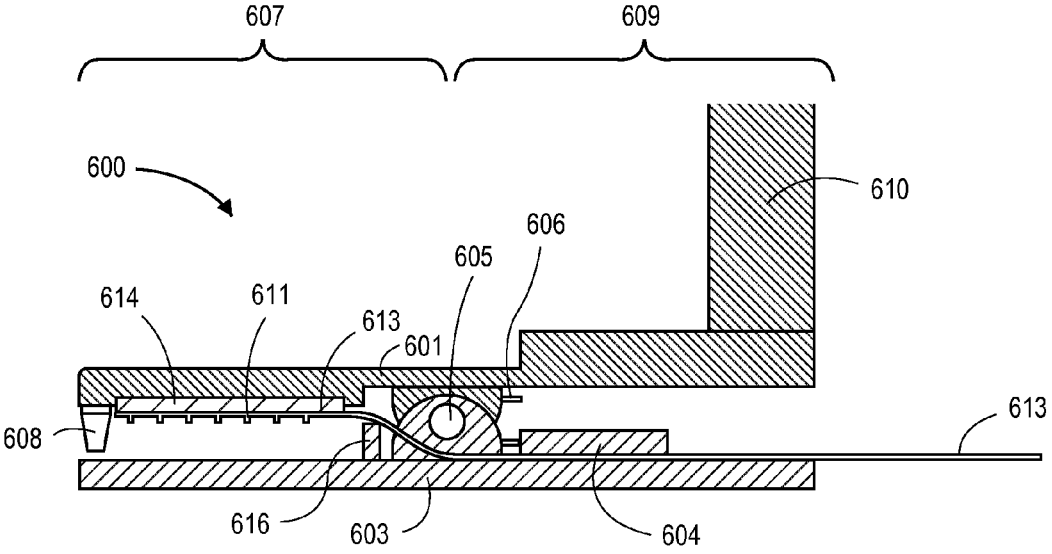
FIGS. 6A-6B illustrate a side view and isometric view of a clip-type connector with bump-on-flex compatibility, in accordance with an embodiment of the invention.
Figure 6B:
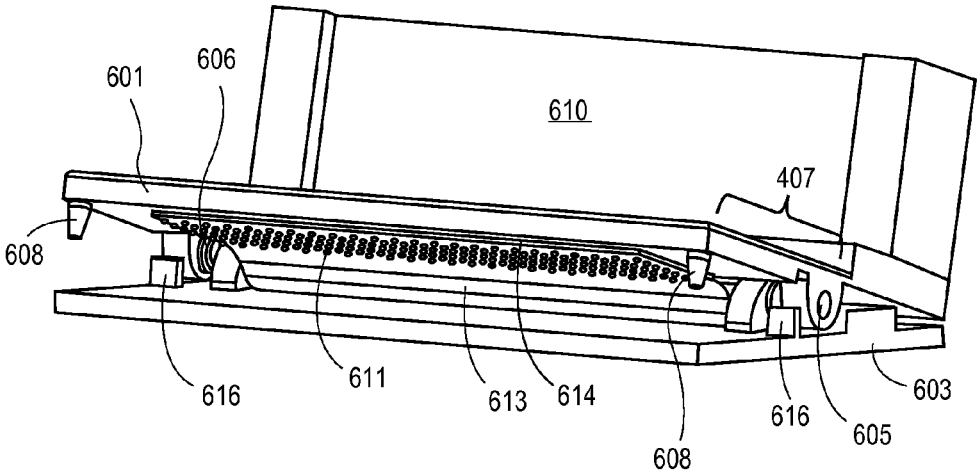

FIGS. 6A-6B illustrate a side view and an isometric view of a clip-type connector with bump-on-flex compatibility, in accordance with an embodiment of the invention. The clip-type connector with bump-on-flex compatibility is capable of electrically coupling a flex cable having an array of contact bumps to a package substrate. Accordingly, the package substrate may be electrically coupled with a separate device or substrate, such as a PCB, through the flex cable or an array of coaxial cables electrically connected to the flex cable. Currently, package substrates are electrically coupled to a PCB through a solder bump arrangement or an LGA-type connection arrangement, which have a maximum data transfer rate in the range of 8 to 12 Gb/s due to surface area constraints. Bump-on-flex cables, on the other hand, are not significantly limited by such surface area constraints. As such, in an embodiment, flex cables can operate at data transfer rates greater than 20 Gb/s. Therefore, for high-speed applications such as high-volume processing or high-speed memory access, bump-on-flex cables may be preferred over conventional solder bump or LGA-type connections.

Referring now to FIG. 6A, a clip-type connector 600 with bump-on-flex compatibility includes a top plate 601 and a bottom plate 603 mechanically coupled to one another by a spring-loaded hinge 605. The spring-loaded hinge 605 is located between the top and bottom plates 601 and 603. The top plate 601 and bottom plate 603 each have an engaging region 607 and a non-engaging region 609 that are separated by the location of the hinge 605. In the embodiment depicted in FIG. 6A, a plate extension 610 extends from the non-engaging region 609 of the top plate 101. The plate extension 610 elevates the location where force (such as $F_2$ from FIG. 3A) is applied for ease of access purposes when space is limited, such as when the clip-type connector 600 is positioned near a heat sink. In an embodiment, the spring-loaded hinge 605 includes a spring 606, such as a torsional spring, that draws the engaging regions 607 of the top and bottom plates 601 and 603 toward one another. In an embodiment, the spring 606 is secured to the clip-type connector 600 by a spring securer 604. The top plate 601 also includes a locking feature 608 and a stopping feature 616 for reasons disclosed above.

As shown in FIG. 6A, the engaging region 607 of the top plate 601 is attached to a bump-on-flex cable 613. In an embodiment, the bump-on-flex cable 613 extends from the engaging region 607, through the non-engaging region 609, and out of the clip-type connector 600. The bump-on-flex cable 613 may tuck underneath the hinge 605 and thread through the gap between the hinge 605 and the bottom plate 603. In an embodiment, an array of micro coaxial cables electrically connect with the bump-on-flex cable 613 at the end outside of the clip-type connector 600. An array of contacts 611 are disposed on a portion of the bump-on-flex cable 613 within the engaging region 607. In an embodiment, the contacts 611 are disposed on an end of the bump-on-flex cable 613 opposite of the end connected to the array of micro coaxial cables. In an embodiment, the contacts 611 are copper cylinders, or any other suitable conductive structures, such as solder bumps, that are electrically coupled to respective wires in the flex cable 613. The contacts 611 act as both a mechanical and electrical interface for the bump-on-flex cable 613. Bump-on-flex cables provide a substantially short electrical path to the signal, resulting in significantly lower electrical resistance and cross talk. However, achieving consistent minimum force required to enable electrical connection with a surface proves difficult because of the minimal mechanical compliance of the bumps. To mitigate such difficulty, a compliant mattress 614 may be located between the bump-on-flex cable 613 and the top plate 101, directly above the contacts 611. In an embodiment, the compliant mattress 614 is a foam pad, a spring mattress, or any other structure that can apply conformal pressure on uneven surfaces. The compliant mattress may be attached between the top plate 601 and the bump-on-flex cable 613 by any suitable attachment method, such as but not limited to, adhesives, screws, pins, or a combination thereof. The compliant mattress 614 may compensate for variation in bump height caused by package substrate warpage and/or manufacturing non-coplanarity to enable the array of contacts 611 to apply even pressure to a substrate. The specific structure of a spring mattress will be discussed further below.

FIG. 6B illustrates an isometric view of an opened clip-type connector 600 with bump-on-flex compatibility according to an embodiment of the invention. The bump-on-flex cable 613 is secured to the engaging region 407 of the top plate 601 with a compliant mattress 614. The compliant mattress 614 is located between the bump-on-flex cable 613 and the top plate 601, and above the array of contacts 611. As shown in FIG. 6B, in an embodiment, the array of contacts 611 on the flex cable 613 spans across greater than half the distance of a width of the top plate 601. In an embodiment, the width is the distance that runs parallel to the hinge 105. The width of the flex cable 613 may widen or narrow depending on design, and the arrangement of the contacts 611 may scale accordingly. In an embodiment, the width of the flex cable 613 is not wider than the width of the plate to which it is attached.

Figure 6C:
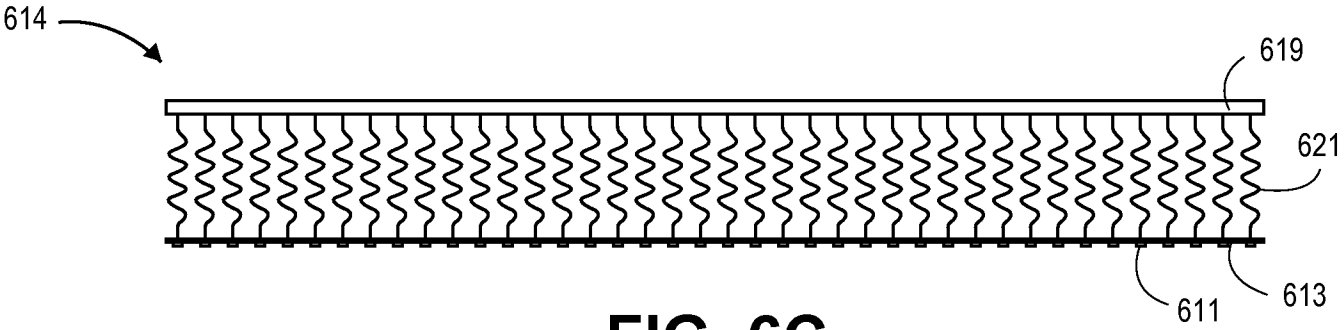
FIG. 6C illustrates a side view perspective of a compliant pad for a clip-type connector with bump-on-flex compatibility, in accordance with an embodiment of the invention.
Figure 6D:
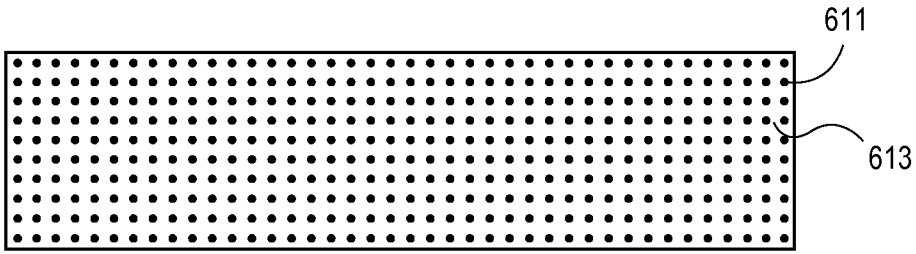
FIG. 6D illustrates a top view perspective of an array of contacts on a bump-on-flex cable, in accordance with an embodiment of the invention.

FIGS. 6C-6D illustrate an enlarged view of a spring mattress and bump-on-flex arrangement according to embodiment of the invention. FIG. 6C illustrates a side view perspective of a compliant mattress 614 designed as a spring mattress for a clip-type connector with bump-on-flex compatibility, in accordance with an embodiment of the invention. In an embodiment, the spring mattress includes an array of springs 621 perpendicularly attached between a pressure plate 619 and a flex cable 613. In an embodiment, the pressure plate is a separate, rigid plate that is attached to the top plate 601. Alternatively, in an embodiment, the pressure plate 619 is the top plate 601 itself. The pressure plate provides a structural foundation for the springs 621. The flex cable 613 has an array of contacts 611 for making electrical connection with a substrate. Each spring 621 may be located behind a contact 611 to allow the contact to traverse in a vertical direction. As such, the contact 611 may conform to any unevenness on the substrate or from any variation in contact size to apply equal pressure to each pad on the substrate. In an embodiment, each spring 621 allows the contact 611 to travel a vertical distance of up to 1 mm.

With reference now to FIG. 6D, a top view perspective of the contact arrangement of a bump-on-flex cable is illustrated. In an embodiment, the contacts 611 on the flex cable 613 are arranged in an m×n array. For example, as shown in the embodiment depicted in FIG. 6D, the array of contacts 611 is in a 10×40 arrangement. Other embodiments, however, are not limited to such arrangements, and may have scaled rows and/or columns according to design.

Figure 7A:
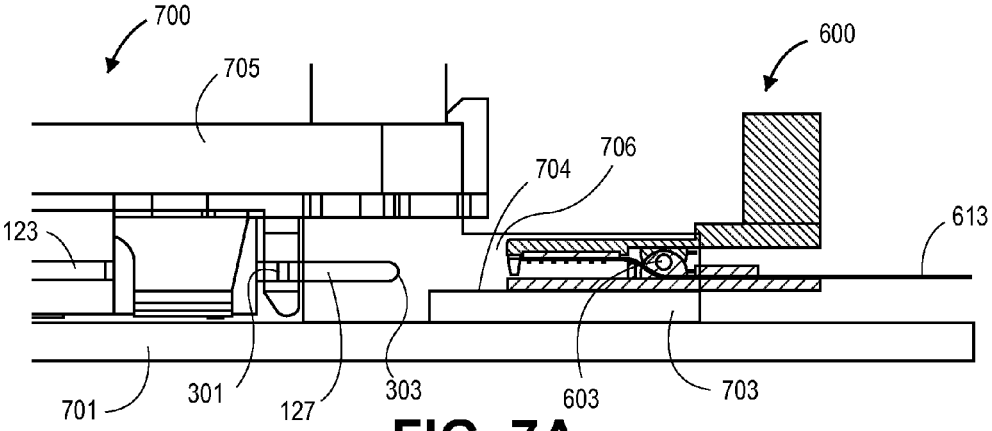
FIGS. 7A-7C illustrate a method of engaging a clip-type connector with bump-on-flex compatibility to be in electrical connection with a package substrate, in accordance with an embodiment of the invention.
Figure 7B:
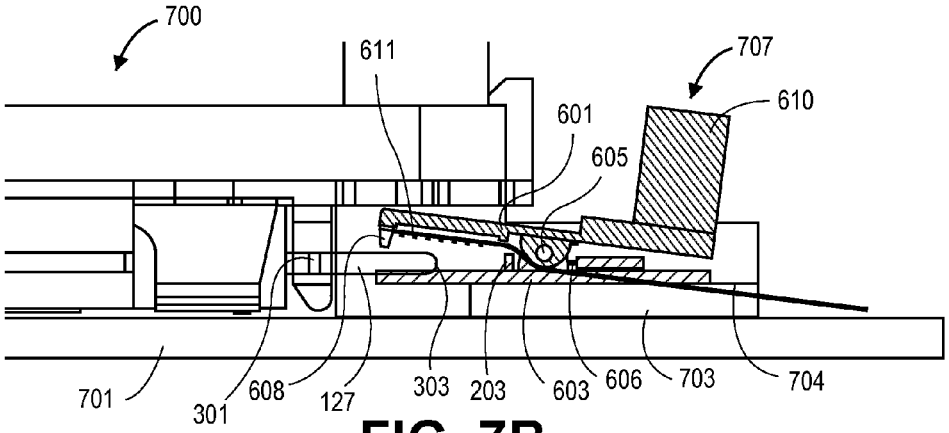
Figure 7C:
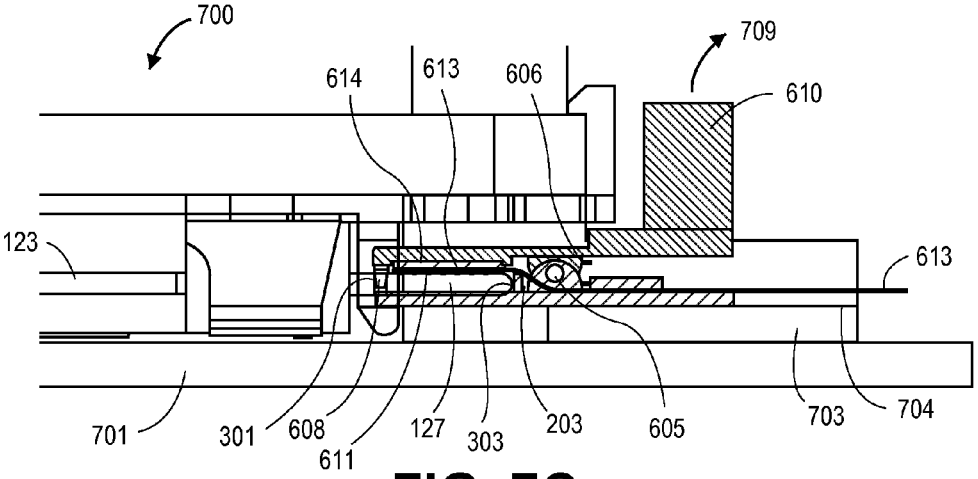

FIGS. 7A-7C illustrate a method of connecting a clip-type connector with bump-on-flex compatibility to a package substrate, in accordance with an embodiment of the invention. As shown in FIG. 7A, in an embodiment, the clip-type connector 600 with bump-on-flex compatibility is setting up for connection to a package 700. The package 700 may include a package carrier 701, an alignment guide 703, a package substrate 123 with a diving board 127, a die (such as die 125 from FIG. 2A not shown here) electrically coupled to the package substrate 123, and a heat sink 705. The package carrier 701 may be a foundation structure that supports structures layered upon it, such as the heat sink 705, the package substrate 123, and the die. In an embodiment, the alignment guide 703 is an elevated structure with a flat top surface 704 and alignment walls 706 on each side. The alignment guide 703 may be used for coarse alignment of the clip-type connector 600 to the diving board 127 in the x, y, and z direction. As shown in FIG. 7A, the clip-type connector 600 initially rests upon the top surface 704 of the alignment guide 703 and between the alignment walls 706.

Next, as illustrated in FIG. 7B, a force 707, such as force $F_2$ in FIG. 3A, is applied on the plate extension 610 to open the clip-type connector 600 as described in FIG. 3A above. The top and bottom plates 601 and 603 pivot at the spring-loaded hinge 605 such that the locking features 608 and contacts 611 raise above the height of the diving board 127. Thereafter, the clip-type connector 600 slides on the top surface 704 of the alignment guide 703 toward the package 700. Because the locking features 608 and the contacts 611 have been raised above the diving board 127, the locking feature 608 and the contacts 611 do not travel on the diving board 127. Once the edge 303 of the diving board 127 makes contact with the stopping feature 203, tactile feedback is given in the form of a collision, which triggers release of the force 707.

In FIG. 7C, the clip-type connector 600 is engaged in electrical connection with the package substrate 123. When the force is unapplied 709, the spring-loaded hinge 605 draws the contacts 611 onto respective pads on the diving board 127. Due to the compliant mattress 614, the contacts 611 apply significantly even pressure against each pad on the diving board 127 despite any surface unevenness on the diving board 127 or difference in coplanarity across the contacts 611. In addition, the locking features 608 on the top plate 601 slide into the locking keys 301 on the diving board 127. Once the locking features 608 are set, the clip-type connector 600 is not able to be separated from the diving board 127 without reapplying the force 707. As such, the package substrate 123, including all electrical devices electrically coupled with it, such as the die 125, is now electrically coupled with the flex cable 613. In an embodiment, the flex cable 613 is connected to an array of micro coaxial cables, which are then connected to another device or substrate, such as a PCB.

Figure 8A:
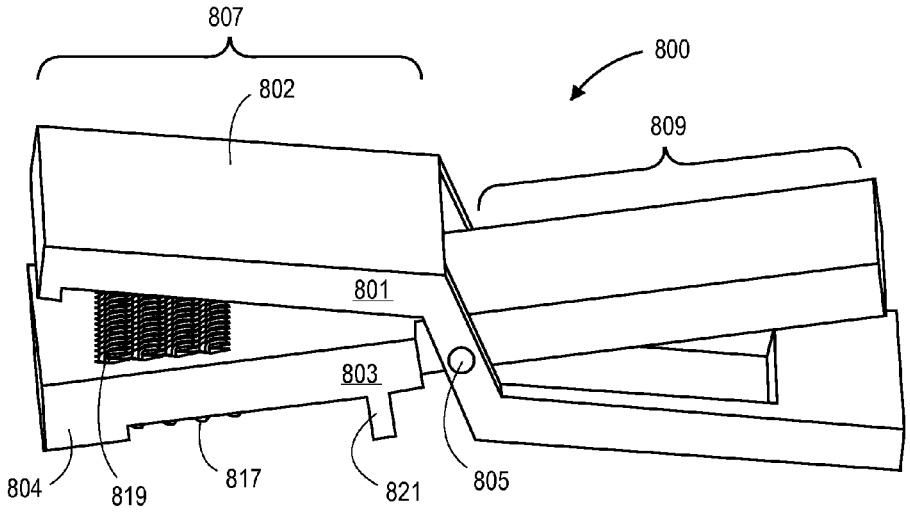
FIGS. 8A-8B illustrate an inverted clip-type connector with an array of contacts, in accordance with an embodiment of the invention.
Figure 8B:
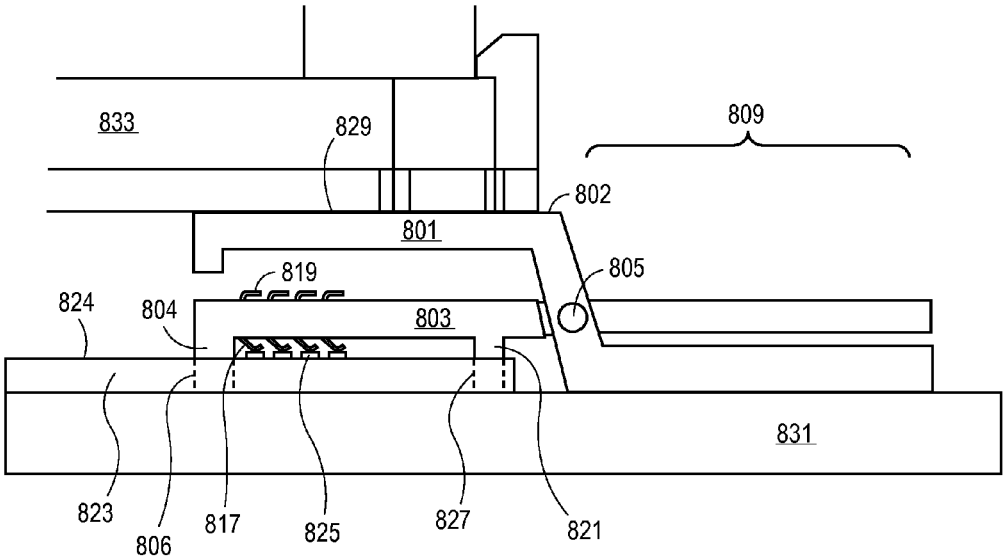

FIGS. 8A-8B illustrate an inverted clip-type connector with an array of contacts, in accordance with an embodiment of the invention. In an embodiment, the inverted clip-type connector repels an engaging region of a top plate and a bottom plate away from one another. The inverted clip-type connector may be suitable for situations where a package substrate does not have enough space underneath for the bottom plate to fit.

FIG. 8A illustrates an isometric view of an inverted clip-type connector 800 with an array of contacts 817, in accordance with an embodiment of the invention. The inverted clip-type connector 800 has a top plate 801 that crosses with a bottom plate 803 at a spring-loaded hinge 805. The spring-loaded hinge 805 mechanically connects the top plate 801 with the bottom plate 803. The inverted clip-type connector 800 has an engaging region 807 and a non-engaging region 809 that are separated by the spring-loaded hinge 805. In an embodiment, the spring-loaded hinge 805 repels the top and bottom plates 801 and 803 away from one another. The bottom plate 803 has an array of contacts 817 protruding downwards and an array of couplers 819 protruding upwards. The array of contacts 817 may be scaled and spring-typed as disclosed above. In an embodiment, the contacts 817 are electrically coupled to the couplers 819, which may be electrically coupled to a flex cable to electrically couple the contacts 817 to another device or a PCB. An aligning feature 821 protrudes downward from the bottom plate 803 of the inverted clip-type connector 800 to help align the connector 800 to a substrate. Furthermore, a locking feature 804 protrudes downward from the bottom plate 803 to secure the connector 800 from inadvertently separating from a substrate.

FIG. 8B illustrates a side view perspective of an inverted clip-type connector 800 engaged in electrical connection with a package substrate 823 having an array of pads 825. In the depicted embodiment, the package substrate 823 is directly on a package carrier 831. Accordingly, there is no space for a bottom plate from a clip-type connector to fit. As such, the inverted clip-type connector 800 is used as shown in FIG. 8B. Pressure is applied to the array of pads 825 by the spring-loaded hinge 805. The spring-loaded hinge 805 may use any suitable surface to create a reaction force to press the array of contacts 817 on the array of pads 825. In an embodiment, the spring-loaded hinge 805 uses a bottom surface 829 of a heat sink 833 to create a reaction force for the array of contacts 817 to press against the array of pads 825. To engage the inverted clip-type connector 800 with the substrate 823, force (such as force $F_2$ in FIG. 3 above) is applied to close inverted clip-type connector 800. The connector 800 is then inserted into the space between the package substrate 823 and the heat sink 829. When the aligning feature 821 is inserted into an alignment key 827, the force is then unapplied to engage the inverted clip-type connector 800. Locking features 804 then fit into locking keys 806 within the package substrate 823 to prevent the inverted clip-type connector 800 from inadvertently separating from the package substrate 823. The array of contacts 817 are electrically coupled to the array of pads 825.

Figure 9:
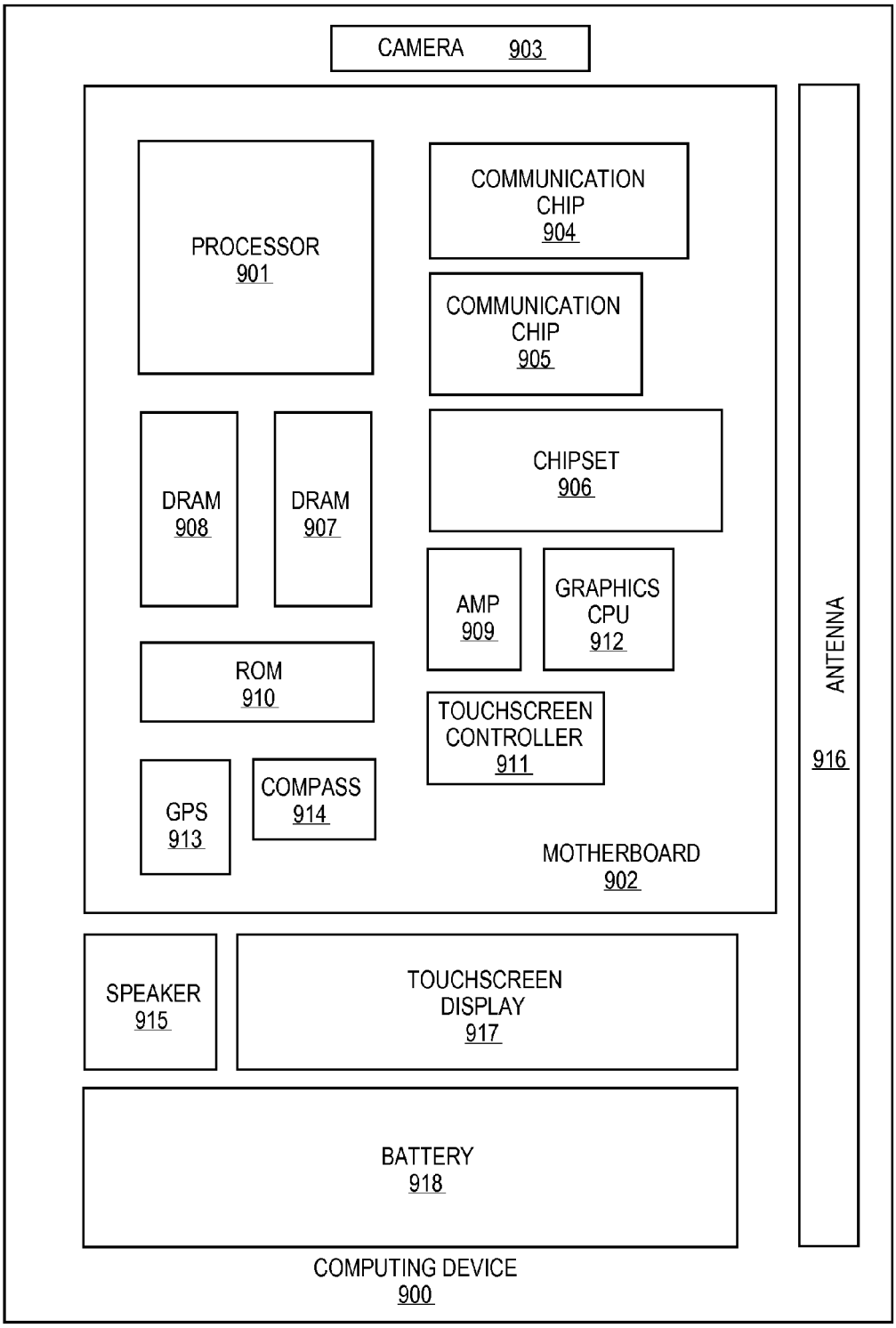
FIG. 9 illustrates a computing system implemented with one implementation of the invention.

FIG. 9 illustrates a computing system 900 implemented with one implementation of the invention. The computing device 900 houses a board 902. The board 902 may include a number of components, including but not limited to a processor 904 and at least one communication chip 906. The processor 904 is physically and electrically coupled to the board 902. In some implementations the at least one communication chip 906 is also physically and electrically coupled to the board 902 with a clip-type connector. In further implementations, the communication chip 906 is part of the processor 904.

Depending on its applications, computing device 900 may include other components that may or may not be physically and electrically coupled to the board 902. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

The communication chip 906 enables wireless communications for the transfer of data to and from the computing device 900. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 906 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 9G, 4G, 5G, and beyond. The computing device 900 may include a plurality of communication chips 906. For instance, a first communication chip 906 may be dedicated to shorter range wireless communications such as Wi-Fi and Bluetooth and a second communication chip 906 may be dedicated to longer range wireless communications such as GPS, EDGE, GPRS, CDMA, WiMAX, LTE, Ev-DO, and others.

The processor 904 of the computing device 900 includes an integrated circuit die packaged within the processor 904. In some implementations of the invention, the processor is electrically coupled to another device or the printed circuit board by a clip-type connector, in accordance with implementations of the invention. The term "processor" may refer to any device or portion of a device that processes electronic data from registers and/or memory to transform that electronic data into other electronic data that may be stored in registers and/or memory.

The communication chip 906 also includes an integrated circuit die packaged within the communication chip 906. In accordance with another implementation of the invention, the integrated circuit die of the communication chip is electrically coupled to another device or a printed circuit board with a clip-type connector in accordance with implementations of the invention.

In further implementations, another component housed within the computing device 900 may be electrically coupled to another device or a printed circuit board with a clip-type connector in accordance with implementations of the invention.

In various implementations, the computing device 900 may be a laptop, a netbook, a notebook, an ultrabook, a smartphone, a tablet, a personal digital assistant (PDA), an ultra mobile PC, a mobile phone, a desktop computer, a server, a printer, a scanner, a monitor, a set-top box, an entertainment control unit, a digital camera, a portable music player, or a digital video recorder. In further implementations, the computing device 900 may be any other electronic device that processes data.

In an embodiment, an electrical connector includes a top plate; a bottom plate; an array of contacts on at least one of the top plate and bottom plate; a hinge between the top plate and the bottom plate, the hinge mechanically connecting the top plate to the bottom plate; and a spring applying a force against the top and bottom plates. Additionally, in an embodiment, the force draws an engaging region of the top plate toward an engaging region of the bottom plate. Furthermore, in an embodiment, the force repels an engaging region of the top plate away from an engaging region of the bottom plate. Moreover, in an embodiment, the array of contacts comprises copper cylinders on a bump-on-flex cable. In one embodiment, the array of contacts is a spring-type contact. Furthermore, in one embodiment, the spring-type contact is a cantilever contact. Additionally, in one embodiment, the spring is located in the hinge, forming a spring-loaded hinge. In an embodiment, the spring is a spring selected from the group consisting of a torsional spring and a sheet metal spring. Moreover, in an embodiment, the spring comprises a pair of linear springs between the top and bottom plates on either side of the hinge perpendicularly connected to the top and bottom plates. Additionally, in an embodiment, the top plate comprises a top locking feature. Furthermore, in an embodiment, the bottom plate comprises a bottom locking feature. In one embodiment, the bottom plate comprises a stopping feature.

In an embodiment, an electronic assembly includes a package comprising a die electrically coupled to a substrate, the substrate comprising a diving board that protrudes from an edge of the substrate; an electrical connector electrically coupled to the substrate through the diving board, the electrical connector comprising: a top plate, a bottom plate, an array of contacts on at least one of the top plate and bottom plate, a hinge between the top plate and the bottom plate, the hinge mechanically connecting the top plate to the bottom plate, and a spring applying a force against the top and bottom plates; and a cable electrically coupled to the electrical connector, the electrical connector is electrically coupled to the substrate. Additionally, in an embodiment, the substrate is a package substrate. Moreover, in an embodiment, the diving board comprises an array of pads, each pad of the array of pads does not extend to an edge of the diving board. Furthermore, in an embodiment, the edge of the diving board contacts a stopping feature on the electrical connector. In one embodiment, the diving board comprises a locking key. Additionally, in one embodiment, the locking key is a notch formed at an edge of the diving board into which a locking feature on the electrical connector fits. Moreover, in one embodiment, the cable is a flex cable. In an embodiment, the flex cable comprises an array of contacts on a first end of the flex cable. Additionally, in an embodiment, the electronic assembly further includes a compliant mattress disposed behind the array of contacts and between the flex cable and at least one of the top and bottom plate. Furthermore, in an embodiment, the flex cable is electrically coupled to a coaxial cable at a second end of the flex cable, the second end is opposite of the first end. Moreover, in an embodiment, the force draws an engaging region of the top plate towards an engaging region of the bottom plate.

In an embodiment, a method of forming an electronic assembly includes providing a package comprising a die electrically coupled to a substrate, the substrate comprising a diving board that protrudes from an edge of the substrate; providing an electrical connector comprising: a top plate, a bottom plate, an array of contacts on at least one of the top plate and bottom plate, a hinge between the top plate and the bottom plate, the hinge mechanically connecting the top plate to the bottom plate, and a spring applying a force against the top and bottom plates; applying force upon a non-engaging region of the electrical connector; aligning the electrical connector and the diving board to one another; and removing the force, causing electrical coupling between the electrical connector and the substrate. Additionally, in an embodiment, the array of contacts do not travel on the substrate. Furthermore, in an embodiment, applying the force causes an engaging end of the electrical connector to open. Moreover, in an embodiment, applying the force causes an engaging end of the electrical connector to close. In one embodiment, the electrical coupling is created by a closing force generated by a spring in the electrical connector. Additionally, in one embodiment, aligning the electrical connector includes inserting a locking feature into a locking key. Furthermore, in one embodiment, aligning the electrical connector includes the substrate contacting a stopping feature on the electrical connector.

In utilizing the various aspects of this invention, it would become apparent to one skilled in the art that combinations or variations of the above embodiments are possible for electrically coupling a semiconductor die to another device or a printed circuit board with a clip-type connector. Although embodiments of the present invention have been described in language specific to structural features and/or methodological acts, it is to be understood that the invention defined in the appended claims is not necessarily limited to the specific features or acts described. The specific features and acts disclosed are instead to be understood as particularly graceful implementations of the claimed invention useful for illustrating embodiments of the present invention.

What is claimed is:

1. An electrical connector, comprising:

a top plate, the top plate having a top surface and an opposite bottom surface;

a bottom plate, the bottom plate having a top surface and an opposite bottom surface, the top surface of the bottom plate facing the bottom surface of the top plate;

an array of contacts on at least one of the top plate and bottom plate, wherein the array of contacts extends from the top surface to the bottom surface of the at least one of the top plate and bottom plate;

a hinge between the top plate and the bottom plate, the hinge mechanically connecting the top plate to the bottom plate; and a spring applying a force against the top and bottom plates.

2. The electrical connector of claim 1, wherein the force draws an engaging region of the top plate toward an engaging region of the bottom plate.

3. The electrical connector of claim 1, wherein the array of contacts comprises copper cylinders on a bump-on-flex cable.

4. The electrical connector of claim 1, wherein the array of contacts is a spring-type contact.

5. The electrical connector of claim 4, wherein the spring-type contact is a cantilever contact.

6. The electrical connector of claim 1, wherein the spring is located in the hinge, forming a spring-loaded hinge.

7. The electrical connector of claim 1, wherein the spring comprises a pair of linear springs between the top and bottom plates on either side of the hinge perpendicularly connected to the top and bottom plates.

8. The electrical connector of claim 1, wherein the top plate comprises a top locking feature.

9. The electrical connector of claim 1, wherein the bottom plate comprises a bottom locking feature.

10. The electrical connector of claim 1, wherein the bottom plate comprises a stopping feature.

11. An electronic assembly, comprising:

a package comprising a die electrically coupled to a substrate, the substrate comprising a diving board that protrudes from an edge of the substrate;

an electrical connector electrically coupled to the substrate through the diving board, the electrical connector comprising:

a top plate, a bottom plate, an array of contacts on at least one of the top plate and bottom plate, a hinge between the top plate and the bottom plate, the hinge mechanically connecting the top plate to the bottom plate, and a spring applying a force against the top and bottom plates; and a cable electrically coupled to the electrical connector, the electrical connector is electrically coupled to the substrate.

12. The electronic assembly of claim 11, wherein the substrate is a package substrate.

13. The electronic assembly of claim 12, wherein the diving board comprises an array of pads, each pad of the array of pads does not extend to an edge of the diving board.

14. The electronic assembly of claim 13, wherein the edge of the diving board contacts a stopping feature on the electrical connector.

15. The electronic assembly of claim 11, wherein the diving board comprises a locking key.

16. The electronic assembly of claim 15, wherein the locking key is a notch formed at an edge of the diving board into which a locking feature on the electrical connector fits.

17. The electronic assembly of claim 11, wherein the cable is a flex cable.

18. The electronic assembly of claim 17, wherein the flex cable comprises an array of contacts on a first end of the flex cable.

19. The electronic assembly of claim 18, further comprising a compliant mattress disposed behind the array of contacts and between the flex cable and at least one of the top and bottom plate.

20. A method of forming an electronic assembly, comprising:

providing a package comprising a die electrically coupled to a substrate, the substrate comprising a diving board that protrudes from an edge of the substrate;

providing an electrical connector comprising:

a top plate, a bottom plate, an array of contacts on at least one of the top plate and bottom plate, a hinge between the top plate and the bottom plate, the hinge mechanically connecting the top plate to the bottom plate, and a spring applying a force against the top and bottom plates;

applying force upon a non-engaging region of the electrical connector;

aligning the electrical connector and the diving board to one another; and removing the force, causing electrical coupling between the electrical connector and the substrate.

21. The method of claim 20, wherein the array of contacts do not travel on the substrate.

22. The method of claim 20, wherein applying the force causes an engaging end of the electrical connector to open.

23. The method of claim 20, wherein electrical coupling is created by a closing force generated by a spring in the electrical connector.

24. The method of claim 20, wherein aligning the electrical connector includes inserting a locking feature into a locking key.

25. The method of claim 20, wherein aligning the electrical connector includes the substrate contacting a stopping feature on the electrical connector.

* * * * *